United States Patent [19]

Ekerot et al.

[11] Patent Number: 4,930,755

[45] Date of Patent: Jun. 5, 1990

[54] METHOD FOR HEATING CERAMIC MATERIAL, PRIMARILY IN CONJUNCTION WITH THE USE OF SUCH MATERIAL IN METALLURGICAL PROCESSES, AND AN ARRANGEMENT FOR CARRYING OUT THE METHOD

[75] Inventors: Sven Ekerot, Minervavägen 19, 191 50 Sollentuna; Jan Svennebrink, Järfälla, both of Sweden

[73] Assignee: Sven Ekerot, Sollentuna, Sweden

[21] Appl. No.: 213,611

[22] PCT Filed: Dec. 29, 1986

[86] PCT No.: PCT/SE86/00586

§ 371 Date: Jun. 27, 1988

§ 102(e) Date: Jun. 27, 1988

[87] PCT Pub. No.: WO87/04099

PCT Pub. Date: Jul. 16, 1987

[30] Foreign Application Priority Data

Dec. 30, 1985 [SE] Sweden ..... 8506158

[51] Int. Cl.[5] ..... B22D 41/00

[52] U.S. Cl. ..... 266/44; 266/281

[58] Field of Search ..... 266/280, 281, 44; 164/50

[56] References Cited

U.S. PATENT DOCUMENTS 4,324,602 4/1982 Davis et al. ..... 266/281

*Primary Examiner*—S. Kastler

*Attorney, Agent, or Firm*—Nies, Kurz, Bergert & Tamburro

[57] ABSTRACT

A method for primarily pre-heating ceramic material primarily in metallurgical processes, the material, in the form of brick or the like, forming part of a lining (3) or the like and being intended to be brought into contact with molten metal, such as molten steel, or a like melt, either directly or indirectly. Heating is effected primarily to reduce the magnitude of the temperature changes that occur in the material as a result of the alternating presence and absence of molten metal, or of a like melt that has an effect on the material.

The method is particularly characterized in that heating is effected with the aid of so-called microwaves, and in that the cavity required herefor is formed by an existing metallic casing (2), preferably a steel casing, together with requisite auxiliary casing devices (4), such as lid devices (4) around the material. At least one microwave generator (7) is connected to the cavity.

The invention also relates to an arrangement for carrying out the method.

23 Claims, 2 Drawing Sheets

METHOD FOR HEATING CERAMIC MATERIAL, PRIMARILY IN CONJUNCTION WITH THE USE OF SUCH MATERIAL IN METALLURGICAL PROCESSES, AND AN ARRANGEMENT FOR CARRYING OUT THE METHOD

The present invention relates to a method for heating ceramic material primarily in conjunction with the use of such material in metallurgical processes.

The invention also relates to an arrangement for carrying out the method.

Because of the high temperatures that occur in metallurgical processes, particularly in steel manufacturing processes, matters that concern the refractory brick and linings employed play an important role in the efficiency and economy of the process, both from an economical and practical aspect. The choice of brick material used is the result of a compromise made between, inter alia, such parameters as high temperature erosion properties, insulating properties, temperature shock stability, the cost of raw materials, and manufacturing costs. The brick is subjected to particularly high stresses when coming suddenly into contact with molten steel. The resultant rapid change in the temperature of the brick surfaces results in the occurrence of superficial cracks and so-called spalling. Naturally, these phenomena negatively affect the long-term durability of the brick.

Although these problems can be alleviated by pre-heating the bricks, the temperature achieved when using known brick heating techniques, normally affected with the aid of oil or gas burners or electrical heating devices, seldom exceed about 1000° C. All of these techniques employ some form of indirect heating method, which in itself results in a pronounced temperature gradient in the brick surfaces during the course of pre-heating the brick. Because the known techniques employ indirect heating methods, these techniques have a low degree of efficiency and have hitherto resulted in a cost of from 10 to 20 Swedish Crowns for each ton of steel produced.

In addition to the aforesaid drawback relating to temperature shock, the fact that present day pre-heating techniques when put into practice seldom result in temperatures above 1000° C. introduces a further drawback, namely the drop in temperature to which the molten steel is subjected, this drop in temperature being the result of an increase in the temperature of, inter alia, the brick, the refractory lining. This drop in the temperature of the steel may reach to several tens of degrees of centigrade and must be compensated for by heating the molten steel bath to corresponding over-temperatures, which entails both time and energy costs and results in wear and tear on the furnace brickwork. This drop in temperature may also, in practice, cause difficulties in the form of freezing, so-called pocketing.

The need of heating the brick in steel manufacturing processes is particularly comprehensive, and includes all vessels and transport devices that are used between the steel furnace and the pouring station.

The present invention affords a solution to the above-mentioned problems, in which the ceramic or refractory material, the brick, is heated directly.

The invention thus relates to a method for primarily pre-heat heating ceramic material in primarily metallurgical use, this material, in the form of bricks or corresponding elements, forming part of a lining or the like and being intended to be brought into contact with molten metal, such as molten steel or a corresponding melt, either directly or indirectly, said heating being primarily intended to reduce the magnitude of the temperature changes that take place in the material as a result of the alternating presence and absence of molten metal, or like molten material that has an affect on the ceramic material.

The method is particularly characterized in that heating of the ceramic material is effected with the aid of so-called microwaves, the microwave cavity required herefor being formed by an existing metallic shell or casing, preferably a steel casing, together with requisite auxiliary casing devices, such as lid devices around said material, at least one microwave generator being connected to said cavity in a substantially known manner.

The invention also relates to an arrangement for heating ceramic material, primarily ceramic material used in conjunction with metallurgical processes, said material having the form of bricks or the like which form part of a refractory lining or some corresponding structure and which are intended to come into contact with molten metal, such as molten steel or a corresponding melt, either directly or indirectly, said heating of the ceramic material being effected primarily in order to reduce the magnitude of the temperature changes that occur in the material as a result of the alternating presence and absence of molten metal or a corresponding melt that has an effect on the material.

The arrangement is particularly characterized by devices for heating the material with the aid of microwaves, wherein the cavity required herefor is formed with the aid of an existing metallic casing or shell, preferably a steel casing, together with requisite auxiliary casing devices, such as lid devices, surrounding the material, and wherein at least one microwave generator is connected to the cavity.

The invention will now be described in more detail with reference to exemplifying embodiments thereof and with reference to the accompanying drawings, in which FIG. 1 is a vertical sectional view taken on the line A—A in FIG. 2, and illustrates schematically a first embodiment of a lining heating arrangement according to the invention shown in conjunction with a ladle, some of the structural elements not being shown in section;

Figure 1:
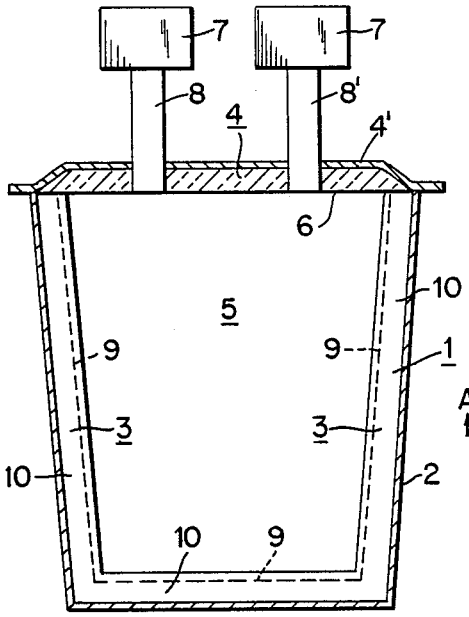
Figure 2:
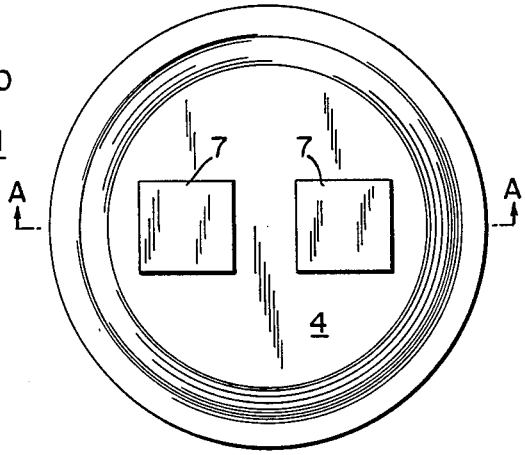
FIG. 2 is a top plan view of the arrangement illustrated in FIG. 1.

FIGS. 1 and 2 illustrate a normal pre-heating application, namely the pre-heating of a container vessel in the form of a schematically illustrated ladle 1 used in steel manufacturing processes. The ladle includes an external steel shell 2 which embraces an internal layer 3 of ceramic material, or materials, forming the ladle lining.

The reference 4 indicates shell or casing devices, lid devices, which together with the shell 2 define the necessary cavity for heating by microwaves at least a part of the lining, a metallic lid, preferably a steel lid 4, covering the openings 5 of the ladle, said hollow being of appreciable size and facing upwards when the vessel, the ladle, is mounted in the conventionally intended manner, as illustrated in FIG. 1. The lid 4 comprises an outer casing 4', preferably made of steel, which is lined internally with a heat insulating layer 6. This layer exhibits but very small loss factors and will not therefore be heated to any appreciable extent by microwaves.

According to preferred embodiments, at least one microwave generator 7 is located in the vicinity of said lid devices 4, preferably adjacent to the lid 4, and is connected by means of waveguides 8 to the cavity formed. The embodiment illustrated in FIGS. 1 and 2 incorporates two generators 7.

In many cases the ceramic material, which is intended to be heated by microwaves and which therefore exhibits significant loss factors, preferably forms those parts 9 of the lining that are intended to come into contact with, e.g., a molten steel bath. These bath contacting parts 9 are shown in FIG. 1. As indicated in FIG. 1, insulating parts are preferably incorporated between the bath contacting parts 9 of the lining and the ladle shell 2.

Figure 3:
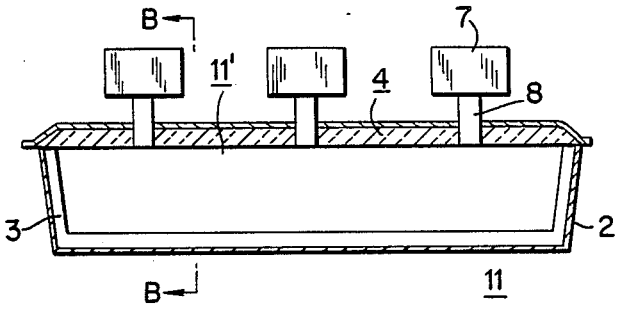
FIG. 3 is a vertical, longitudinal, sectional view which illustrates schematically a second embodiment of a lining heating arrangement according to the invention used in conjunction with a pouring box, in which some details have not been shown in section.
Figure 4:
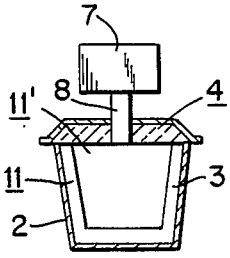
FIG. 4 is a sectional view taken on line B—B in FIG. 3.

The embodiment illustrated in FIGS. 3 and 4 comprises an elongated, relatively shallow container vessel 11, such as a so-called pouring box 11, the outlet of which is not shown in FIGS. 3 and 4. Similar to the ladle 1, the vessel 11 comprises a metallic outer shell 2 which embraces a ceramic lining 3. The outwardly facing opening 11' of the vessel 11 is covered by elongated lid devices 4, in a manner corresponding to the ladle 1, wherewith a suitable number of microwave generators are provided, in the illustrated embodiment of FIGS. 3 and 4 three such generators 7, these generators being connected to the defined cavity by waveguides 8.

Figure 5:
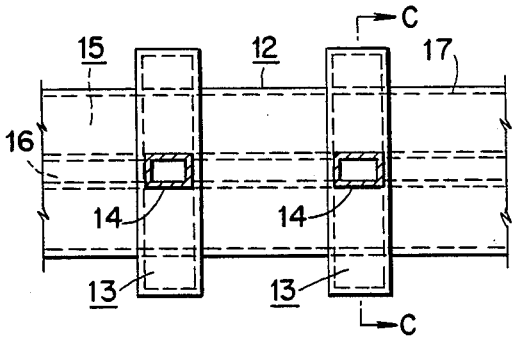
FIG. 5 is a sectional view of one embodiment of a molten metal delivery pipe or conduit, the lining of which is heated in accordance with the invention.
Figure 6:
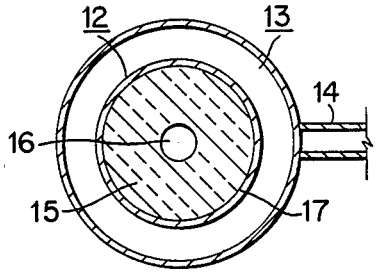
FIG. 6 is a sectional view taken on the line C—C in FIG. 5.

In the embodiment illustrated in FIGS. 5 and 6 the ceramic material to be heated, pre-heated, is enclosed by the lining of a liquid-metal delivery conduit 12 intended e.g., for conducting molten steel, this embodiment incorporating microwave applicators 13 which are distributed along the conduit so as to supply microwaves thereto. The reference 14 indicates waveguides which establish a connection between generators (not shown) and the applicators 13. The conduit 12 suitably has extending therethrough an essentially tubular ceramic part 15 which presents a through-bore 16 for the passage of molten material therethrough, and which preferably adjoins an outer metallic casing 17, preferably made of steel. Each applicator is suitably arranged concentrically with the part 15 and comprises, e.g., a cylindrical widening of the casing 17.

Figure 7:
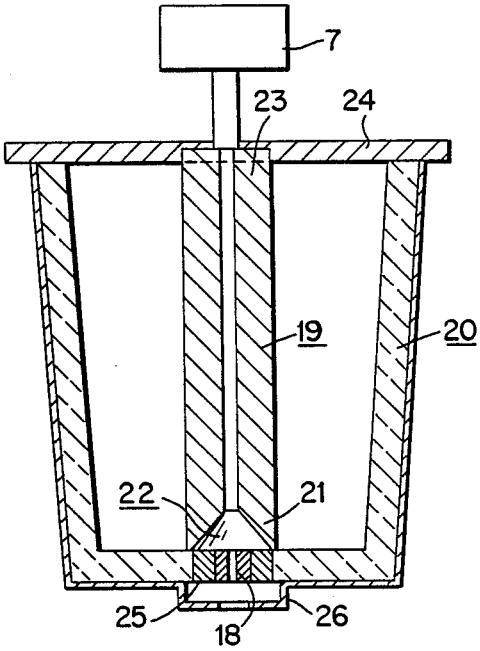
FIG. 7 illustrates schematically and in vertical section an arrangement for heating a nozzle located in the bottom of a ladle.

FIG. 7 illustrates an arrangement which is intended particularly for heating a so-called nozzle 18 which includes a ceramic material that exhibits significant loss factors and which is intended to be heated with the aid of microwaves. Auxiliary casing devices comprising a substantially cylindrical waveguide 19 for microwaves are arranged to be inserted into a container vessel 20, such as a ladle, and to be connected at one end part 21 thereof to the nozzle 18, this end part 21 of the waveguide 19 contributing towards forming a cavity 22. With regard to temperature influence, the waveguide 19 may be cooled in some suitable manner, e.g. water cooled, and may be covered externally with an insulating material. The reference 7 indicates a microwave generator which is connected to the upper part 23 of the waveguide 19. The reference 24 indicates a metallic lid. The nozzle 18 is conveniently embraced by a bush 25 made of a material which will not be heated to any appreciable extent by microwaves. Located beneath the nozzle is a guard 26, preferably a metallic guard, which protects against the leakage of microwaves.

Figure 8:
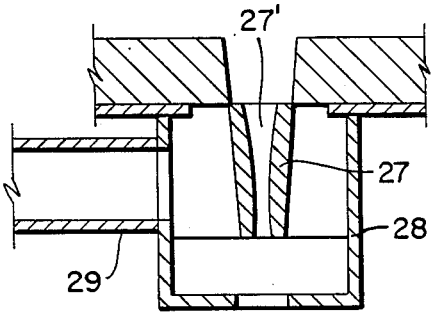
FIG. 8 illustrates schematically an arrangement for heating a nozzle in accordance with the invention.

FIG. 8 illustrates a further arrangement for heating a nozzle 27 incorporating material which is heated by microwaves. In this embodiment a substantially cylindrical cavity, similar to the applicators of the FIG. 5 and 6, is formed by means of a metal casing 28 which forms an applicator 28 and which is supplied with microwaves through a waveguide 29. In accordance with a preferred embodiment, the applicator 28 is constructed to oscillate in a coaxial mode when molten metal runs through the nozzle, and to oscillate in another mode in the absence of molten metal in the through-bore 27' of the nozzle. The cavity, for example, may be of circular cross section substantially at right angles to the longitudinal extension of the through-bore 27' and having a length corresponding to one half wavelength. The cylindrical mode used may be TM 010 the resonance frequency of which is not dependent on length, while the diameter is determined by the resonance frequency. Thus, in this embodiment the diameter and length of the two oscillating modes are each determined per se. More complicated conditions, in which length and diameter are dependent upon one another, can also be applied. The waveguide 29 and the applicator 28 are coupled together, so that both oscillating modes can be excited. This described arrangement provides both pre-heating and back-up heating facilities while molten material passes through the nozzle, thereby enabling blockages etc. to be avoided.

With regard to the composition of the material to be heated by means of microwaves, it can be said that this material preferably comprises a mixture of various ceramic components so adapted that the material obtains a pre-determined so-called loss factor with regard to microwaves.

In many cases the aforesaid material preferably comprises components which exhibit significant loss factors, such as zirconium dioxde, $ZrO_2$.

The method according to the invention and the function of the arrangement according to the invention will be understood in all essentials from the aforegoing. By incorporating in ceramic materials intended primarily for metallurgical use a material which exhibits significant loss factors in regard to microwaves, i.e. will be heated by microwaves, it is possible, by creating a microwave cavity around said material and applying microwaves thereto, to heat ceramic material directly to extremely high temperatures if so desired. The possibilities of controlling temperature, temperature gradient, etc., are extremely good since such parameters as times, the components from which the ceramic material is fabricated, etc., can be selected.

As will be understood from the aforegoing, the invention affords particularly significant advantages over the known prior art. These advantages include, inter alia, high pre-heating temperatures and uniform temperatures.

In the aforegoing the invention has been described with reference to a number of exemplifying embodiments. It will be understood that other embodiments are conceivable and that minor modifications can be made to the illustrated embodiments without departing from the concept of the invention.

For example there can be used as the material to be heated by means of microwaves a suitable stamped monolithic lining, which is suitably located on insulating brick exhibiting low lost factors.

In the aforegoing, ladles, pouring boxes, conduits and nozzles have been recited as examples of vessels or the like or vessel parts suitable for pre-heating/heating by means of microwaves. The method in question, however, can be used to heat several types of vessel and vessel parts. Examples hereof include so-called torpedoes (transport cylinders), stopper rods and die bushes.

With regard to the aforesaid waveguides, such as the waveguides 8, they are normally and preferably of substantially rectangular cross-section, although other cross-sectional shapes are conceivable.

It will also be understood that hollows or cavities which correspond to nozzles or the like through which molten metal is intended to run, and which are intended for injecting, for example, gas and/or particles, can be heated in accordance with the invention for use in those cases where heating requirements prevail.

Furthermore, ceramic filters may need to be preheated in certain instances.

With regard to the composition of the ceramic materials to be heated with the aid of microwaves, measurements have shown that the majority of ceramic materials with solely minor modifications to the composition thereof can be used when heating in accordance with the invention. Suitable materials have been found to be ceramic materials based on $ZrO_2$ or $Al_2O_3$ supplemented with some other oxidic material or materials, such as MgO, $SiO_2$, $Fe_2O_3$, etc.

In the case of embodiments substantially according to FIG. 7, the waveguide may have an antenna effect and contribute towards transmitting microwaves to the nozzle or the like without contributing to form a pronounced cavity.

The invention shall not be considered to be restricted to the aforedescribed embodiments, since modifications can be made within the scope of the following claims.

We claim:

1. A method for pre-heating ceramic material used in metallurgical processes, said material forming part of a lining of a vessel and adapted to be contacted by molten metal melt, in the metallurgical process, said pre-heating being for reducing the magnitude of temperature changes occurring in the material as a result of the alternating presence and absence of molten metal, wherein pre-heating of said material lining the vessel is effected, by means of microwaves, so that the material has been and remains pre-heated when molten metal is being placed in the vessel, the vessel (1,11) including a primary major metallic casing part together with additional metallic casing components (4, 13, 19, 24, 26, 28) which, in conjunction with the primary casing part, complete the casing to form a microwave cavity around and required for pre-heating of said ceramic material, said cavity having at least one microwave generator (7) connected thereto and to provide microwaves into said cavity.

2. A method according to claim 1, wherein said material is admixed with mutually different ceramic components in order to impart to said material sufficient loss factors with regards to microwaves to enable microwave heating of said ceramic material to a high temperature correlated to the temperature of the molten metal melt.

3. A method according to claim 1, comprising including in said material zirconium dioxide, $ZrO_2$, as a component that exhibits substantial loss factors with regard to microwaves.

4. A method according to claim 1, wherein said material forms contact parts (9) that are brought into contact with said molten metal melt, said contact parts (9) being insulated by means of insulating parts (10) located between the contact parts and said casing.

5. A method according to claim 1, wherein said material comprises the lining (3) of a container vessel, which includes a hollow (5,11'), said hollow facing upward when the vessel is mounted in a manner to receive and hold molten metal and being covered with the aid of said metallic casing components (4) which coacts with the metallic primary casing part (2) of the vessel to form a shell which is impervious to microwaves.

6. A method according to claim 5, wherein at least one microwave generator (7) is connected to and through at least one of said casing components (4, 24) by means of a waveguide (8), whereby microwaves generated by said generator are introduced into said cavity.

7. A method according to claim 1, wherein said vessel is a conduit and said material comprises the lining (15) of said conduit (12) intended for conducting molten metal, and wherewith microwaves are supplied for preheating said material before molten metal passes therethrough, by means of microwave applicators (13) arranged along said conduit (12).

8. A method according to claim 1, wherein a nozzle (18,27) or corresponding hollow through which metallurgical process material is intended to pass, incorporates said ceramic material and is pre-heated by means of separate devices forming a cavity connected with the nozzle or corresponding hollow and thereby exercising an antenna effect and thereby cooperating in the transfer of microwaves to the nozzle.

9. An arrangement for heating ceramic material used in metallurgical processes, said material forming at least part of a lining of a metallurgical process vessel and which, in said process, will be brought into contact with molten metal, said heating being intended to reduce the magnitude of temperature changes occurring in the ceramic material as a result of the alternating presence and absence of molten metal, said heating to be performed as an initial part of the metallurgical process before the lining is brought into contact with the molten metal, the improvement including means for effecting said heating with the aid of microwaves, and including a microwave cavity formed by a primary metallic casing part (2) of said vessel (1,11) together with additional separate metallic auxiliary casing components (4, 13, 19, 26, 28), which in conjunction with said primary casing part form a casing enclosure containing said cavity, around said material; and wherein at least one microwave generator (7) is connected to said cavity.

10. An arrangement according to claim 9, wherein said material comprises a mixture of mutually different ceramic components so adapted as to impart to said material a sufficient loss factor with regard to microwaves to enable microwave heating of said ceramic material to a high temperature correlated with the temperature of molten metal.

11. An arrangement according to claim 9, wherein said material includes zirconium dioxide, $ZrO_2$, as a component that exhibits substantial loss factors with regard to microwaves.

12. An arrangement according to claim 9, wherein said material comprises a ceramic material based on $ZrO_2$ or $Al_2O_3$ supplemented with some other oxidic material or materials, such as MgO, $SiO_2$ and $Fe_2O_3$.

13. An arrangement according to claim 9, wherein said ceramic material forms those contact parts (9) that will come into contact with said molten metal, and insulating parts (10) are located between the contact parts and said casing (2).

14. An arrangement according to claim 9, wherein said material comprises a stamped, monolithic lining.

15. An arrangement according to claim 9, wherein said material includes the lining of a container vessel, which presents a hollow (5, 11') said hollow being covered by metallic casing components (4) arranged to co-act with the primary metallic casing part (2) of the vessel to form a shell comprising said cavity which is substantially impervious to microwaves.

16. An arrangement according to claim 9, wherein said vessel is a conduit and said material is included in the lining (15) of said conduit (12) for conducting molten metal, and wherein microwave applicators (13) are disposed, in spaced-apart arrangement along said conduit for supplying microwaves into said conduit.

17. An arrangement according to claim 9, wherein when said vessel is a nozzle (18, 27) or corresponding hollow with a said lining, through which metallurgical process material is intended to pass, separate means are provided which form a cavity in connection with the hollow, therewith cooperating in the transmission of microwaves to the hollow for heating the lining of the same.

18. An arrangement according to claim 17, wherein a bottom nozzle (18) of a container vessel (20) includes said ceramic lining material, said auxiliary casing components comprise a substantially tubular waveguide (19) for microwaves for insertion into the container vessel (20) and having an end part (21) for connection to said nozzle internally of the vessel, said end part cooperating with said nozzle to form a cavity (22) and to exercise an antenna effect for the microwaves.

19. An arrangement according to claim 17, wherein said nozzle has a through-bore and said separate devices include a microwave applicator (28) arranged to oscillate in a coaxial mode when molten metal runs through the through-bore (27') of the nozzle (27), and in another mode in the absence of molten metal in the through-bore of said nozzle.

20. A method as defined in claim 1, wherein the primary casing part is made from steel and the requisite auxiliary casing components include a steel lid which together with the steel casing part of the vessel form the microwave cavity with walls impervious to microwaves to enable said pre-heating by microwaves.

21. An arrangement according to claim 9, wherein said metallic casing part as a steel casing part.

22. An arrangement according to claim 14, wherein insulating brick is provided on which said stamped, monolithic lining, is mounted, and said insulating brick exhibits low loss factors relative to the microwave energy introduced in said cavity.

23. An arrangement according to claim 17, wherein said separate means comprise a waveguide portion in connection with said hollow to exercise an antenna effect for the transmission of microwaves to said hollow for heating the same.

* * * * *

UNITED STATES PATENT AND TRADEMARK OFFICE

CERTIFICATE OF CORRECTION

PATENT NO. : 4,930,755

DATED : June 5, 1990

INVENTOR(S) : SVEN EKEROT and JAN SVENNEBRINK

It is certified that error appears in the above-identified patent and that said Letters Patent is hereby corrected as shown below:

Column 1, line 66, "pre-heat heating" should be --pre-heating--.

Claim 21, column 8, line 2, change "as" to --is--.

Signed and Sealed this

Thirteenth Day of August, 1991

*Attest:*

*Attesting Officer*

HARRY F. MANBECK, JR.

*Commissioner of Patents and Trademarks*